US006041971A

United States Patent [19]

Pineda

[11] Patent Number: 6,041,971

[45] Date of Patent: Mar. 28, 2000

[54] AUTOMATIC SHOWER HAIR PRODUCT DISPENSER

[76] Inventor: Eliath Pineda, 229 Seaman Ave. B-6, New York City, N.Y. 10034

[21] Appl. No.: 09/204,495

[22] Filed: Dec. 3, 1998

[51] Int. Cl.[7] ..... B67D 5/52

[52] U.S. Cl. ..... 222/135; 222/180; 222/181.3; 222/333

[58] Field of Search ..... 222/132, 135, 222/181.3, 380, 333, 181.2, 180; 4/605

[56] References Cited

U.S. PATENT DOCUMENTS

| | | | |
|---|---|---|---|
| 3,720,352 | 3/1973 | Kozlowski | 222/132 |
| 3,917,172 | 11/1975 | O'hare | 239/305 |
| 4,218,013 | 8/1980 | Davison | 239/74 |
| 4,763,494 | 8/1988 | Der Kinderen | 222/135 |
| 4,874,113 | 10/1989 | Schmidt | 222/143 |
| 4,880,145 | 11/1989 | McManus | 222/192 |
| 4,969,580 | 11/1990 | Mikhail Ezzat A. | 222/181 |
| 4,998,647 | 3/1991 | Sharp | 222/143 |
| 5,044,522 | 9/1991 | Roig et al. | 222/108 |
| 5,823,402 | 10/1998 | Moyer et al. | 222/383.1 |

*Primary Examiner*—Andres Kashnikow
*Assistant Examiner*—Jorge Bocanegra

[57] ABSTRACT

A automatic shower hair product dispenser for dispensing liquid hair care products and soap. The automatic shower hair product dispenser includes a housing with a plurality of reservoirs therein. A lower spout is outwardly extended from a front of the housing towards a bottom of the housing. The lower spout is in fluid communication with a first of the reservoirs of the housing. A first valve is positioned between the first reservoir and the lower spout. An upper spout upwardly extends from the top of the housing adjacent a back of the housing. At least one other reservoir is in fluid communication with the upper spout. This reservoir has a pump for pumping fluid therefrom into the upper spout.

9 Claims, 3 Drawing Sheets

FIG. 1
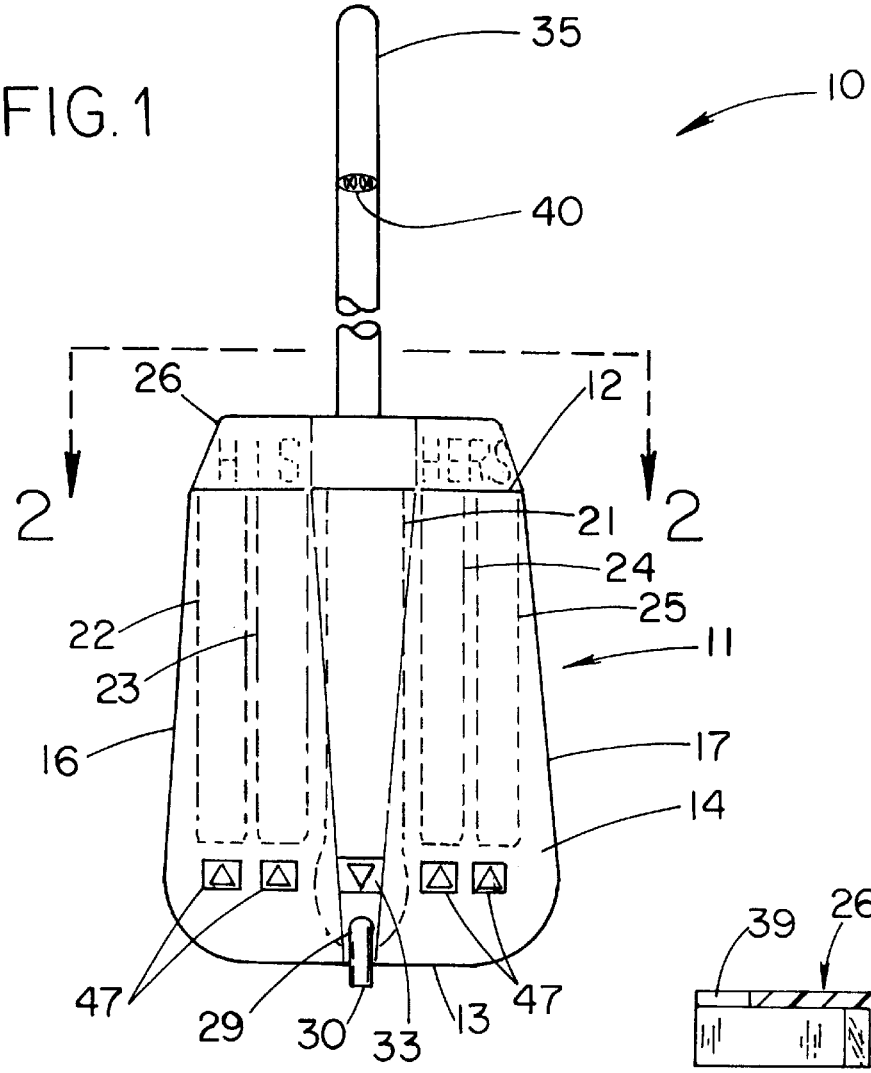
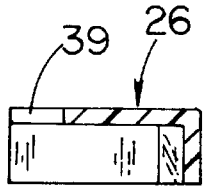
FIG. 3
FIG. 2
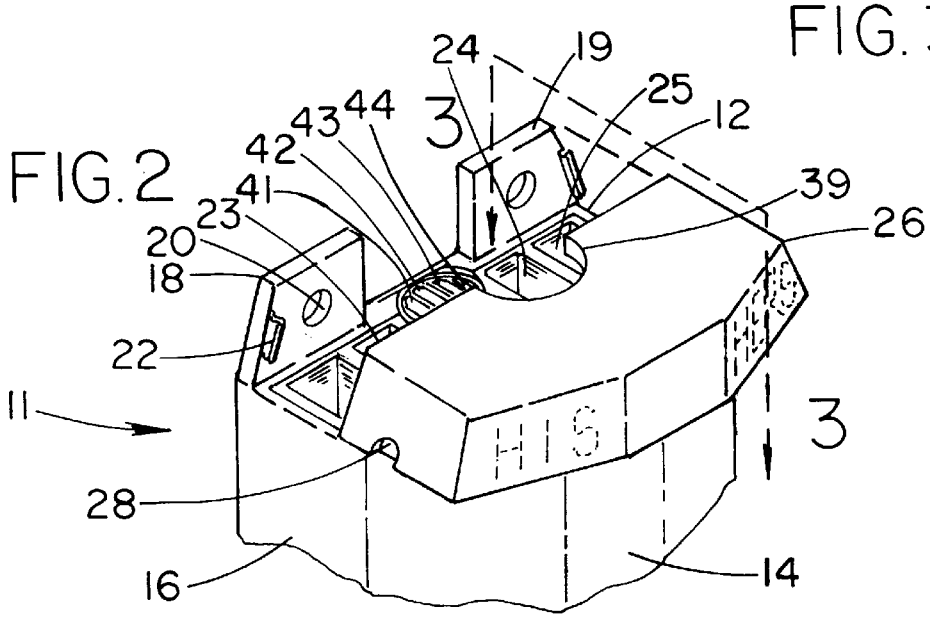

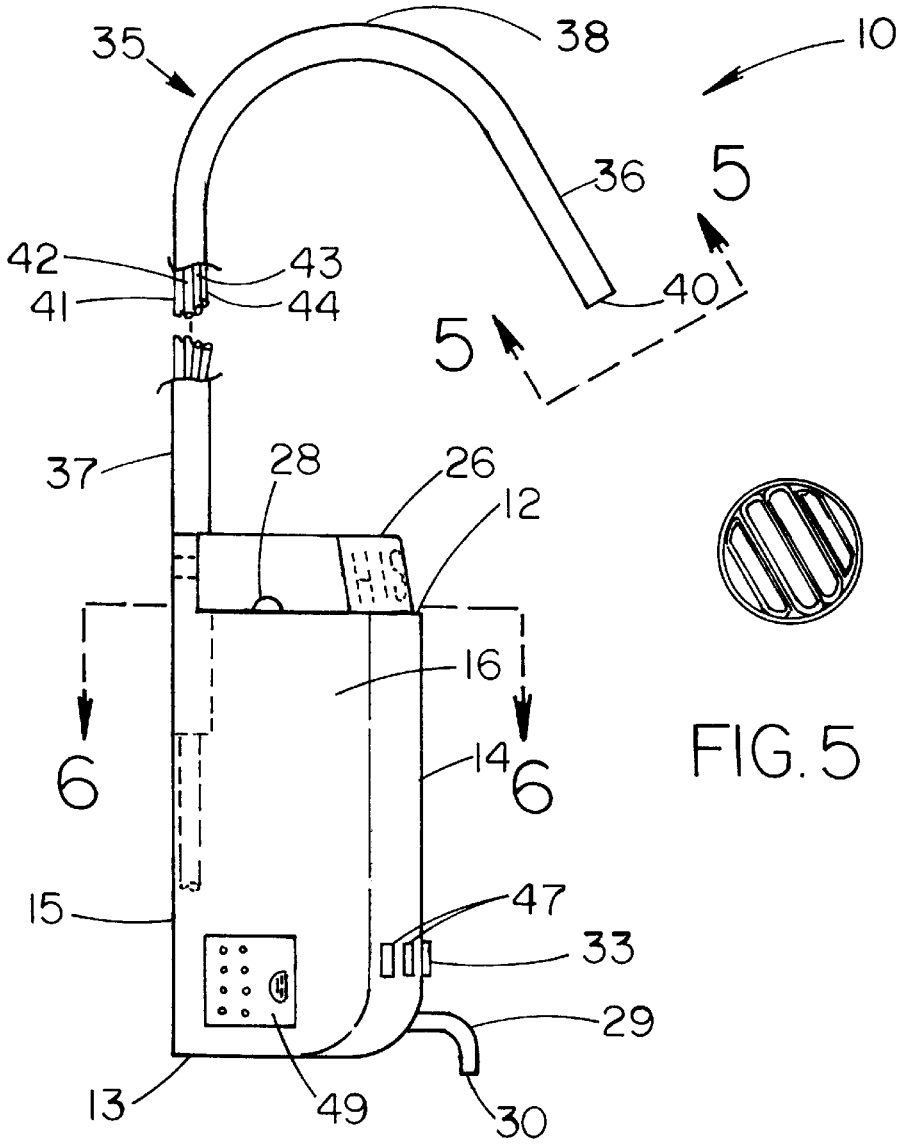
FIG. 4
FIG. 5
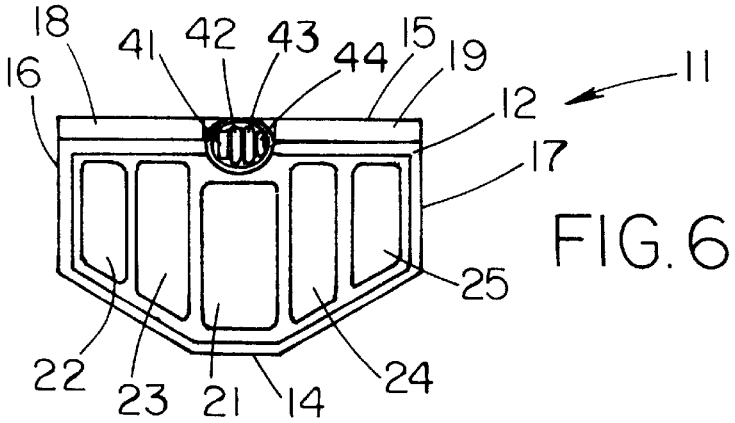
FIG. 6

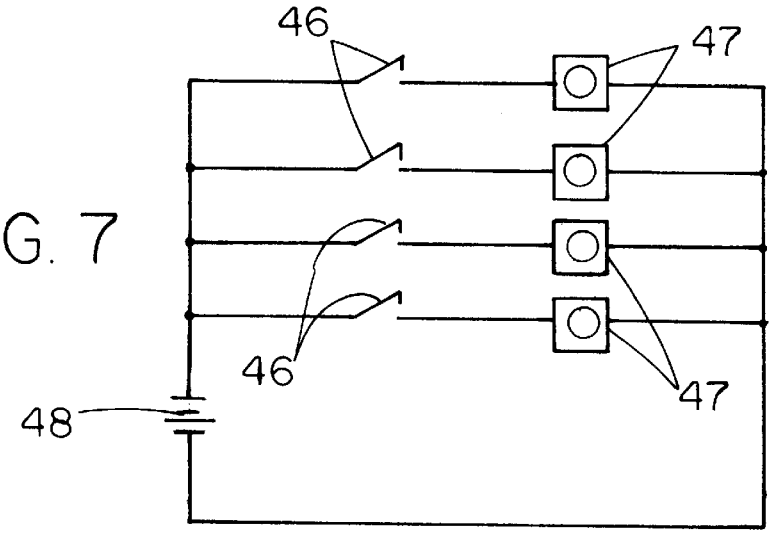
FIG. 7
FIG. 8
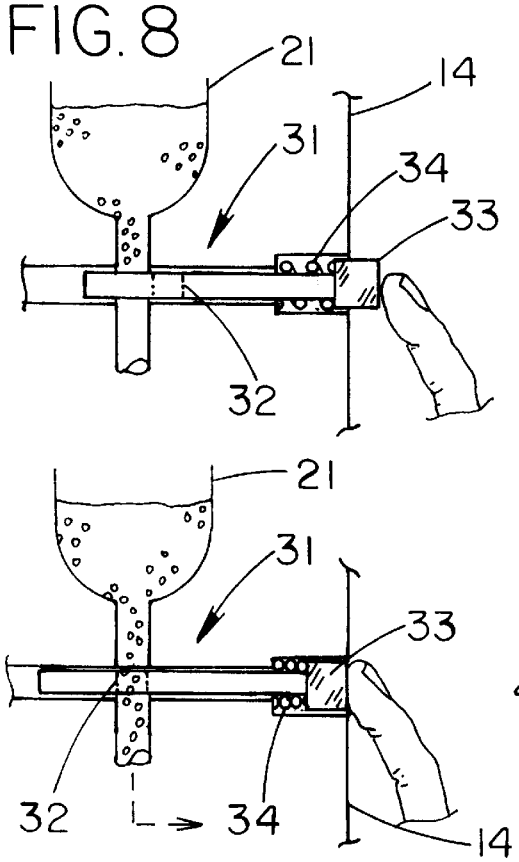
FIG. 9
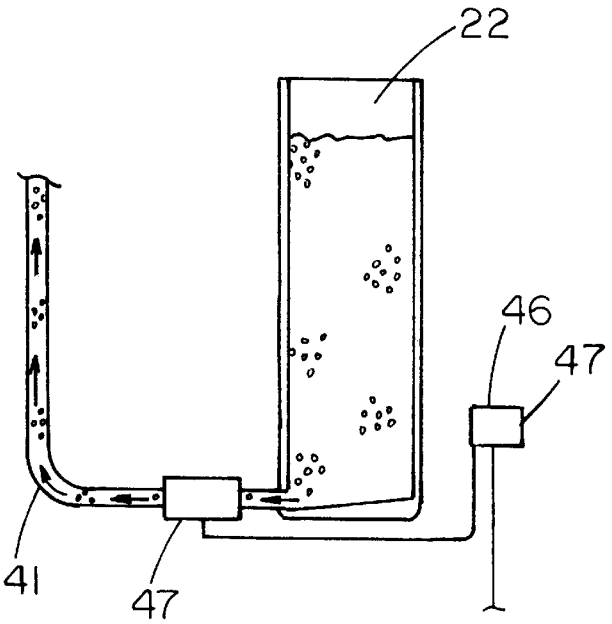
FIG. 10

AUTOMATIC SHOWER HAIR PRODUCT DISPENSER

BACKGROUND OF THE INVENTION

1. Field of the Invention

The present invention relates to dispensers for liquid soaps and shampoos and more particularly pertains to a new automatic shower hair product dispenser for dispensing liquid hair care products and soap.

2. Description of the Prior Art

The use of dispensers for liquid soaps and shampoos is known in the prior art. More specifically, dispensers for liquid soaps and shampoos heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,085,867 by Heller; U.S. Pat. No. 3,990,611 by Sojka; U.S. Pat. No. Des. 333,063 by Podesta Burke; U.S. Pat. No. 4,165,824 by Sud; U.S. Pat. No. 5,044,522 by Roig; U.S. Pat. No. 4,826,048 by Skorka et al.; and U.S. Pat. No. 3,997,080 by Langstroth which are all incorporated by reference herein.

While these devices fulfill their respective, particular objectives and requirements, the aforementioned patents do not disclose a new automatic shower hair product dispenser. The inventive device includes a housing with a plurality of reservoirs therein. A lower spout is outwardly extended from a front of the housing towards a bottom of the housing. The lower spout is in fluid communication with a first of the reservoirs of the housing. A first valve is positioned between the first reservoir and the lower spout. An upper spout upwardly extends from the top of the housing adjacent a back of the housing. At least one other reservoir is in fluid communication with the upper spout. This reservoir has a pump for pumping fluid therefrom into the upper spout.

In these respects, the automatic shower hair product dispenser according to the present invention substantially departs from the conventional concepts and designs of the prior art, and in so doing provides an apparatus primarily developed for the purpose of dispensing liquid hair care products and soap.

SUMMARY OF THE INVENTION

In view of the foregoing disadvantages inherent in the known types of dispensers for liquid soaps and shampoos now present in the prior art, the present invention provides a new automatic shower hair product dispenser construction wherein the same can be utilized for dispensing liquid hair care products and soap.

The general purpose of the present invention, which will be described subsequently in greater detail, is to provide a new automatic shower hair product dispenser apparatus and method which has many of the advantages of the dispensers for liquid soaps and shampoos mentioned heretofore and many novel features that result in a new automatic shower hair product dispenser which is not anticipated, rendered obvious, suggested, or even implied by any of the prior art dispensers for liquid soaps and shampoos, either alone or in any combination thereof.

To attain this, the present invention generally comprises a housing with a plurality of reservoirs therein. A lower spout is outwardly extended from a front of the housing towards a bottom of the housing. The lower spout is in fluid communication with a first of the reservoirs of the housing. A first valve is positioned between the first reservoir and the lower spout. An upper spout upwardly extends from the top of the housing adjacent a back of the housing. At least one other reservoir is in fluid communication with the upper spout. This reservoir has a pump for pumping fluid therefrom into the upper spout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic shower hair product dispenser apparatus and method which has many of the advantages of the dispensers for liquid soaps and shampoos mentioned heretofore and many novel features that result in a new automatic shower hair product dispenser which is ot anticipated, rendered obvious, suggested, or even implied by any of the prior art dispensers for liquid soaps and shampoos, either alone or in any combination thereof.

It is another object of the present invention to provide a new automatic shower hair product dispenser which may be easily and efficiently manufactured and marketed.

It is a further object of the present invention to provide a new automatic shower hair product dispenser which is of a durable and reliable construction.

An even further object of the present invention is to provide a new automatic shower hair product dispenser which is susceptible of a low cost of manufacture with regard to both materials and labor, and which accordingly is then susceptible of low prices of sale to the consuming public, thereby making such automatic shower hair product dispenser economically available to the buying public.

Still yet another object of the present invention is to provide a new automatic shower hair product dispenser which provides in the apparatuses and methods of the prior art some of the advantages thereof, while simultaneously overcoming some of the disadvantages normally associated therewith.

Still another object of the present invention is to provide a new automatic shower hair product dispenser for dispensing liquid hair care products and soap.

Yet another object of the present invention is to provide a new automatic shower hair product dispenser which includes a housing with a plurality of reservoirs therein. A lower spout is outwardly extended from a front of the housing towards a bottom of the housing. The lower spout is in fluid communication with a first of the reservoirs of the housing. A first valve is positioned between the first reservoir and the lower spout. An upper spout upwardly extends from the top of the housing adjacent a back of the housing. At least one other reservoir is in fluid communication with the upper spout. This reservoir has a pump for pumping fluid therefrom into the upper spout.

Still yet another object of the present invention is to provide a new automatic shower hair product dispenser that is mountable to a wall surface in shower structures such as bathtubs and shower stalls.

Even still another object of the present invention is to provide a new automatic shower hair product dispenser that dispenses a metered amount of liquid therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic front view of a new automatic shower hair product dispenser according to the present invention.

FIG. 2 is a schematic partial perspective view of the present invention taken from the vantage of line 2—2 of FIG. 1.

FIG. 3 is a schematic cross sectional view of the lid of the present invention.

FIG. 4 is a schematic side view of the present invention.

FIG. 5 is a schematic end view of the open end of the upper spout of the present invention as seen from line 5—5 of FIG. 4.

FIG. 6 is a schematic top view of the present invention as seen from line 6—6 of FIG. 4.

FIG. 7 is an electrical schematic of the pump system of the present invention.

FIG. 8 is a schematic side view of the first valve in a closed position.

FIG. 9 is a schematic side view of the first valve in an open position.

FIG. 10 is a schematic side view of a pump system of the present invention.

DESCRIPTION OF THE PREFERRED EMBODIMENT

With reference now to the drawings, and in particular to FIGS. 1 through 10 thereof, a new automatic shower hair product dispenser embodying the principles and concepts of the present invention and generally designated by the reference numeral 10 will be described.

As best illustrated in FIGS. 1 through 10, the automatic shower hair product dispenser 10 generally comprises a housing with a plurality of reservoirs therein. A lower spout is outwardly extended from a front of the housing towards a bottom of the housing. The lower spout is in fluid communication with a first of the reservoirs of the housing. A first valve is positioned between the first reservoir and the lower spout. An upper spout upwardly extends from the top of the housing adjacent a back of the housing. At least one other reservoir is in fluid communication with the upper spout. This reservoir has a pump for pumping fluid therefrom into the upper spout.

In use, the dispenser 10 is designed for dispensing liquid hair care products and soaps. In closer detail, The dispenser includes a housing 11 having a top 12, a bottom 13, a front 14, a substantially planar back 15, and a pair of sides 16,17. Preferably, the top and bottom of the housing lie in substantially parallel planes to one another substantially perpendicular to the back of the housing. In this preferred embodiment, the sides of the housing lie in planes converging towards one another in a direction towards the top of the housing. The housing is designed for mounting to a vertical wall surface of a shower structure (such as a bathtub or shower stall) so that the back of the housing abuts or at least faces the vertical wall surface. Preferably, this is achieve by a spaced apart pair of mounting tabs 18,19 upwardly extending from the top of the housing adjacent the back of the housing. Each of the mounting tabs of the housing has a generally circular hole 20 therethrough each designed for extending a fastener therethrough to mount the housing to the vertical wall surface.

The housing has a plurality of reservoirs 21,22,23,24,25 therein each designed for holding a liquid therein. Each of the reservoirs of the housing has a opening therein located on the top of the housing to permit refilling of each of the reservoirs. Ideally, the plurality of reservoirs comprises five reservoirs. The housing has a lid 26 on the top of the housing substantially covering the openings of the reservoirs. The lid is detachable attached to the mounting tabs by catches 27 forwardly extending from the mounting tabs. Preferably, the lid also has a pair of opposite finger notches 28 designed for aiding removing of the lid from the top of the housing with the fingers of a user.

A lower spout 29 is outwardly extended from the front of the housing towards the bottom of the housing. The lower spout is in fluid communication with a first of the reservoirs 21 of the housing. The first of the reservoirs is designed for holding liquid body soap therein. The lower spout is preferably generally L-shaped and has elongate upper and lower portions extending generally perpendicular to one another. The upper portion of the lower spout is positioned adjacent the front of the housing. The lower portion of the lower spout terminates at an open lower end 30 is preferably positioned below a plane in which the bottom of the housing lies.

A first valve 31 is positioned between the first reservoir and the lower spout to selectively open and close passage of fluid between the first reservoir and the lower spout. The first valve has a hole 32 therethrough. The first valve is opened when the hole of the first valve is coaxially aligned with the passage between the first reservoir and the lower spout to permit passage of fluid between the first reservoir and the lower spout. The first valve has a push-button actuator 33 extending from the front of the housing, the push-button actuator of the first valve opening the first valve when depressed. The push-button actuator of the first valve has a spring 34 biasing the push-button actuator of the first valve in an outwards direction from the front of the housing.

An upper spout 35 upwardly extends from the top of the housing adjacent the back of the housing. The upper spout is generally U-shaped and has elongate upper and lower arms 36,37, and an arcuate middle portion 38 connecting the upper and lower arms of the upper spout together. The lower arm of the upper spout is positioned adjacent the top of the housing. The lid has a generally semi-circular cutout 39 at a rear edge of the lid through which the lower arm of the upper spout is extended. The upper arm of the upper spout is downwardly and forwardly extended from the middle portion of the upper spout. The upper arm of the upper spout is extended at an acute angle to the lower arm of the upper spout. Preferably, the acute angle between the upper and lower arms of the upper spout is between about 30 degrees and about 60 degrees. Ideally, the acute angle is about 50 degrees.

The upper arm of the upper spout terminating at an open end 40 positioned above the plane of the top of the housing and in front of the plane of the front of the housing. Second, third, fourth and fifth reservoirs 22,23,24,25 each are in fluid communication with the upper spout to permit passage of fluid from the second, third, fourth and fifth reservoirs into the upper spout. The second, third, fourth, and fifth reservoirs each have an elongate tube 41,42,43,44 in fluid communication therewith to permit passage of fluid into each tube from the associated reservoir. The tubes are extended through the upper spout and each of the tubes terminates at an open terminal end at the open end of the upper arm of the upper spout to permit fluid in each tube pass out of the open end of the upper spout.

Each of the reservoirs has a pump 45 for pumping fluid from the respective reservoir into the associated tube. Each of the pumps has a switch 46 for selectively activating the respective pump to pump fluid. Each switch has a push-button actuator 47 extending from the front of the housing. A battery power source 48 provided in the housing is electrically connected to each of the pumps. The housing has an access panel 49 for providing access to the battery power source.

The housing preferably has indicia adjacent each reservoir indicating the type of liquid to be placed in the adjacent reservoir such a indicia indicating shampoo, conditioner and body soap. The lid preferably has indicia indicating the reservoirs for two separate users such as indicia indicating his and hers reservoirs so that each user has two reservoirs designated to that particular user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispenser for dispensing liquid hair care products and soaps, said dispenser comprising:

a housing having a top, a bottom, a front, a back, and a pair of sides;

said housing having a plurality of reservoirs therein each adapted for holding a liquid therein;

a lower spout being outwardly extended from said front of said housing towards said bottom of said housing, said lower spout being in fluid communication with a first of said reservoirs of said housing;

a first valve positioned between said first reservoir and said lower spout;

an upper spout upwardly extending from said top of said housing adjacent said back of said housing;

at least one other reservoir being in fluid communication with said upper spout;

said other reservoirs having a pump for pumping fluid therefrom into said upper spout.

2. The dispenser of claim 1, wherein said top and bottom of said housing lie in substantially parallel planes to one another substantially perpendicular to said back of said housing, wherein said sides of said housing lie in planes converging towards one another in a direction towards said top of said housing.

3. The dispenser of claim 1, wherein said housing has a spaced apart pair of mounting tabs upwardly extending from said top of said housing adjacent said back of said housing, each of said mounting tabs of said housing having a hole therethrough.

4. The dispenser of claim 1, wherein each of said reservoirs of said housing having a opening located on said top of said housing.

5. The dispenser of claim 4, further comprising a lid substantially covering said openings of said reservoirs.

6. The dispenser of claim 1, wherein said first valve has a push-button actuator extending from said front of said housing.

7. The dispenser of claim 1, wherein said other reservoir has an elongate tube in fluid communication therewith, said tube being extended through said upper spout, said tube terminating at an open terminal end at said open end of said upper arm of said upper spout, said pump for pumping fluid from said other reservoir into said tube.

8. The dispenser of claim 1, wherein said pump has a switch for selectively activating said pump to pump fluid, said switch having a push-button actuator extending from said front of said housing.

9. A dispenser for dispensing liquid hair care products and soaps, said dispenser comprising:

a housing having a top, a bottom, a front, a substantially planar back, and a pair of sides;

said top and bottom of said housing lying in substantially parallel planes to one another substantially perpendicular to said back of said housing;

said sides of said housing lying in planes converging towards one another in a direction towards said top of said housing;

said housing being adapted for mounting to a vertical wall surface such that said back of said housing abuts the vertical wall surface;

said housing having a spaced apart pair of mounting tabs upwardly extending from said top of said housing adjacent said back of said housing;

each of said mounting tabs of said housing having a generally circular hole therethrough each adapted for extending a fastener therethrough to mount said housing to the vertical wall surface;

said housing having a plurality of reservoirs therein each adapted for holding a liquid therein, each of said reservoirs of said housing having a opening located on said top of said housing;

wherein said plurality of reservoirs comprises five reservoirs;

said housing having a lid substantially covering said openings of said reservoirs, said lid being attached to said mounting tabs, wherein said mounting tabs each have a catch detachable attaching the respective mounting tab to said lid;

said lid having a pair of opposite finger notches;

a lower spout being outwardly extended from said front of said housing towards said bottom of said housing, said lower spout being in fluid communication with a first of said reservoirs of said housing;

said lower spout being generally L-shaped and having elongate upper and lower portions extending generally perpendicular to one another, said upper portion of said lower spout being positioned adjacent said front of said housing;

said lower portion of said lower spout terminating at an open lower end positioned below a plane in which said bottom of said housing lies;

a first valve positioned between said first reservoir and said lower spout to selectively open and close passage of fluid between said first reservoir and said lower spout;

said first valve having a push-button actuator extending from said front of said housing;

an upper spout upwardly extending from said top of said housing adjacent said back of said housing;

said upper spout being generally U-shaped and having elongate upper and lower arms, and an arcuate middle portion connecting said upper and lower arms of said upper spout together;

said lower arm of said upper spout being positioned adjacent said top of said housing;

said lid having a generally semi-circular cutout, said lower arm of said upper spout being extended through said cutout of said lid;

said upper arm of said upper spout being downwardly and forwardly extended from said middle portion of said upper spout;

said upper arm of said upper spout being extended at an acute angle to said lower arm of said upper spout, wherein said acute angle between said upper and lower arms of said upper spout is between about 30 degrees and about 60 degrees;

said upper arm of said upper spout terminating at an open end;

a second, third, fourth and fifth reservoirs each being in fluid communication with said upper spout to permit passage of fluid from said second, third, fourth and fifth reservoirs into said upper spout;

said second, third, fourth, and fifth reservoirs each having an elongate tube in fluid communication therewith;

said tubes being extended through said upper spout, each of said tubes terminating at an open terminal end at said open end of said upper arm of said upper spout;

each of said reservoirs having a pump for pumping fluid from the respective reservoir into the associated tube, each of said pumps having a switch for selectively activating the respective pump to pump fluid;

each switch having a push-button actuator extending from said front of said housing; and a battery power source being electrically connected to each of said pumps, said battery power source being provided in said housing, said housing having an access panel for providing access to said battery power source.

* * * * *